US005988128A

United States Patent [19]

Moriya et al.

[11] Patent Number: 5,988,128

[45] Date of Patent: Nov. 23, 1999

[54] VALVE DRIVING APPARATUS FOR ENGINE

[75] Inventors: Yoshihito Moriya, Nagoya; Kiyoshi Sugimoto, Okazaki; Tadao Hasegawa; Noriyuki Iden, both of Toyota, all of Japan

[73] Assignee: Toyota Jidosha Kabushiki Kaisha, Toyota, Japan

[21] Appl. No.: 09/047,249

[22] Filed: Mar. 24, 1998

[30] Foreign Application Priority Data

Mar. 27, 1997 [JP] Japan ..... 9-075487
Apr. 4, 1997 [JP] Japan ..... 9-086711

[51] Int. Cl.[6] ..... F01L 13/00

[52] U.S. Cl. ..... 123/90.18; 123/90.22; 123/90.5

[58] Field of Search ..... 123/90.15, 90.17, 123/90.18, 90.22, 90.27, 90.48, 90.5

[56] References Cited

U.S. PATENT DOCUMENTS

| | | | |
|---|---|---|---|
| 4,635,592 | 1/1987 | Weichsler | 123/90.18 |
| 4,658,780 | 4/1987 | Hosoi | 123/90.22 |
| 4,773,359 | 9/1988 | Titolo | 123/90.22 |
| 4,850,311 | 7/1989 | Sohn | 123/90.18 |
| 5,337,712 | 8/1994 | Reitz | 123/90.22 |
| 5,445,117 | 8/1995 | Mendler | 123/90.18 |
| 5,606,942 | 3/1997 | Tsuzuku et al. | 123/90.28 |
| 5,645,023 | 7/1997 | Regueiro | 123/90.22 |
| 5,673,661 | 10/1997 | Jesel | 123/90.48 |
| 5,682,849 | 11/1997 | Regueiro | 123/90.22 |

FOREIGN PATENT DOCUMENTS

| | | |
|---|---|---|
| 570963 | 11/1993 | European Pat. Off. . |
| 3-179116 | 8/1991 | Japan . |
| 7-279631 | 10/1995 | Japan . |

*Primary Examiner*—Weilun Lo
*Attorney, Agent, or Firm*—Kenyon & Kenyon

[57] ABSTRACT

A valve driving apparatus for an internal combustion engine. Each combustion chamber has a pair of intake ports and a pair of intake valves for selectively opening and closing the intake ports. Each intake valve is driven with a variable amount of valve lift. The apparatus includes a camshaft rotatably supported by the engine, cams, cam followers, a shaft moving mechanism, and brackets. Each cam lifts an associated intake valve in response to rotation of the camshaft. Each cam has a cam nose for lifting a corresponding intake valve. The radius of the cam nose varies in the axial direction. Cam followers transmit movement of the intake cams to the intake valves. The shaft moving mechanism moves the cams relative to the valves in an axial direction of the camshaft thereby varying the amount of valve lift. A lifter structure is provided that is circularly shaped to improve manufacturing accuracy. In another embodiment, the valves are oriented to increase the amount of axial movement that the cam can make, which results in greater optimization of the air intake amount.

10 Claims, 11 Drawing Sheets

VALVE DRIVING APPARATUS FOR ENGINE

BACKGROUND OF THE INVENTION

The present invention relates to a valve driving apparatus for engines. More particularly, the present invention pertains to a valve driving apparatus that varies performance of a set of intake valves and a set of exhaust valves in an engine according to the operating conditions of the engine by changing the positions of valve actuating cams.

Existing engines have valve driving apparatuses with low speed cams and high speed cams, which have different profiles, provided on an intake camshaft or an exhaust camshaft. The apparatus switches between the low speed cams and the high speed cams in accordance with the operating conditions of the engine thereby changing the valve timing or the valve lift of the intake valves or the exhaust valves. Using two sets of cams having different profiles, the apparatus makes the maximum lift amount of the valves relatively small when the engine speed is low and makes the maximum valve lift amount of the valves relatively large when the engine speed is high. In this manner, the apparatus guarantees optimum engine characteristics such as torque and stability both in the low speed range and in the high speed range of the engine.

FIG. 12 shows a valve driving apparatus of another type used in an engine having four valves per cylinder. This apparatus is provided on a camshaft 42 (either the intake or exhaust camshaft of the engine), which is supported by a bearing 44. Cams 40 are fixed on the camshaft 42. A pair of the cams 40 corresponds to a pair of valves 43 (either intake or exhaust valves) located in an engine cylinder. Each cam 40 is a solid cam having a surface 40*a*. The cam nose radius of each cam 40 continuously varies in the axial direction of the camshaft 42. The cams 40 are integrally moved with the camshaft 42 in the axial direction (to the left or the right in the drawing) by a shaft moving mechanism 41. This changes the effective cam nose radius of the cams 40.

The range of change of the maximum lift amount (hereinafter, referred to as the lift control amount) is determined according to the difference between the maximum value and the minimum value of the radius of the cam nose. The axial position of the cam shaft 42 is controlled such that the maximum lift of the valves 43 is small in the low engine speed range and is large in the high engine speed range. Therefore, the apparatus of FIG. 12 optimizes engine characteristics such as the torque and stability both in the low speed range and in the high speed range of the engine.

A valve lifter 49 is located between each valve 43 and the corresponding cam 40. A cam follower 45 is pivotally located on top of each valve lifter 49. The surface 45*a* of the cam follower 45 slidably contacts the cam surface 40*a*. The cam follower 45 pivots as it slides on the cam surface 40*a*. That is, the surface 45*a* of the cam follower 45 functions as a sliding surface that slides on the cam surface 40*a*.

In such an engine having four valves per cylinder, the bearing 44 must be located between a pair of cams 40 that correspond to a single combustion chamber for ensuring sufficient rigidity of the camshaft 42. Also, the distance between the valves 43 is determined in accordance with the size of each combustion chamber and cannot be widened. The axial moving amount D of the cams 40 is therefore limited to avoid interference between the cams 40 and the bearing 44. Further, the size of the combustion chamber, that is, the distance between the adjacent valves 43 limits the axial moving amount D of the cams 40. The limited axial moving amount D of the cams 40 corresponds to an insufficient range of valve performance variation, or an insufficient lift control amount of the valves 43.

For increasing the lift control amount in an engine having four valves per cylinder, Japanese Unexamined Patent Publication 3-179116 discloses another type of valve driving apparatus. This apparatus includes a single valve lifter for actuating a pair of valves. FIG. 13 shows a partial cross-sectional view of the apparatus.

The apparatus includes a single cam 51 and a single valve lifter 59 that correspond to two valves 58. The two valves 58 are actuated by the single cam 51 through the single valve lifter 59. This construction increases the width W the cam 51 and the axial moving amount D of the cam 51 compared to the apparatus of FIG. 12 without changing the inclination angle θ of the cam nose. Accordingly, the lift control amount is increased.

As shown in FIG. 14, the valve lifter 59 is shaped like a rectangle with rounded ends when viewed from above. In other words, its side surface has an oblong shape Accordingly, the bore formed in the cylinder head for accommodating the lifter must also be shaped like a rectangle with rounded ends. Therefore, compared to circular valve lifter, it is difficult to obtain the required dimensional accuracy of the valve lifter 59. Further, the valve lifter 59 supports two valves 58 at predetermined positions. This complicates the construction of the valve lifter 59. Further, the valve lifter 59 and the corresponding oblong lifter opening are larger than a valve lifter that actuates a single valve and its corresponding lifter opening. Therefore, it is difficult to achieve the required assembly tolerances for the valve lifter 59 and the corresponding lifter opening. Hence, the manufacture of the valve lifter 59 and the engine is significantly complicated.

Methods to increase the lift control amount without changing the width W of cams and the moving amount D of the cams include increasing the inclination angle θ of the cam surface 40*a* for increasing the difference between the maximum value and the minimum values of the radius of the cam nose. However, increasing the inclination angle θ of the cam nose increases force required for moving the cam shaft 42 to the right in FIG. 12. In order to gain the sufficient force to move the camshaft 42, the valve moving apparatus 41 needs to be enlarged.

Another method is to decrease the width S of the sliding surface 45*a* of each cam follower 45. This increases the effective length of the cam surface 40*a* on which the cam follower 45 moves. However, decreasing the width S of the sliding surface 45*a* increases the pressure acting on the sliding surface 45*a*. The increased pressure accelerates the wear of the cam follower 45 thereby drastically reducing the durability of the cam follower 45.

SUMMARY OF THE INVENTION

Accordingly, it is an objective of the present invention to provide a valve driving apparatus that is used in an engine having multiple intake or exhaust valves per cylinder for increasing the range of valve performance (lift control amount of valves) and is easy manufacture.

To achieve the foregoing and other objectives and in accordance with the purpose of the present invention, a valve driving apparatus for an engine is provided. The apparatus a camshaft rotatably supported by the engine, a combustion chamber having a pair of ports and a pair of valves associated with the ports, respectively, for selectively opening and closing the respective ports. The valves each have a longitudinal axis, a head end, and an outer end, which is opposite to the head end. The valves are oriented with their longitudinal axes inclined with respect to a radius of the cam shaft such that the distance between the head ends of the valves is less than the distance between the outer ends. A pair of cams are provided on the camshaft. Each cam is associated with one of the valves and lifts the associated valve along its axis in response to rotation of the camshaft. Each cam has a cam nose for lifting the associated valve. The radius of the cam nose varies in the axial direction so that each valve is driven with a variable amount of valve lift. The apparatus further includes a pair of cam followers and an actuator. The cam followers transmit movement of the cams to the valves, respectively. Each cam follower contacts the associated cam at a contact position. The actuator moves each cam relative the associated valve in the axial direction of the camshaft to vary the amount of valve lift of each valve. The movement of each cam varies the contact position of each cam follower on the associated cam.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 4(*b*) is a plan view showing the valve lifter of FIG. 4(*a*);

DETAILED DESCRIPTION OF THE PREFERRED EMBODIMENTS

One embodiment of the present invention will be described with reference to FIGS. 1 to 3.

Figure 2:
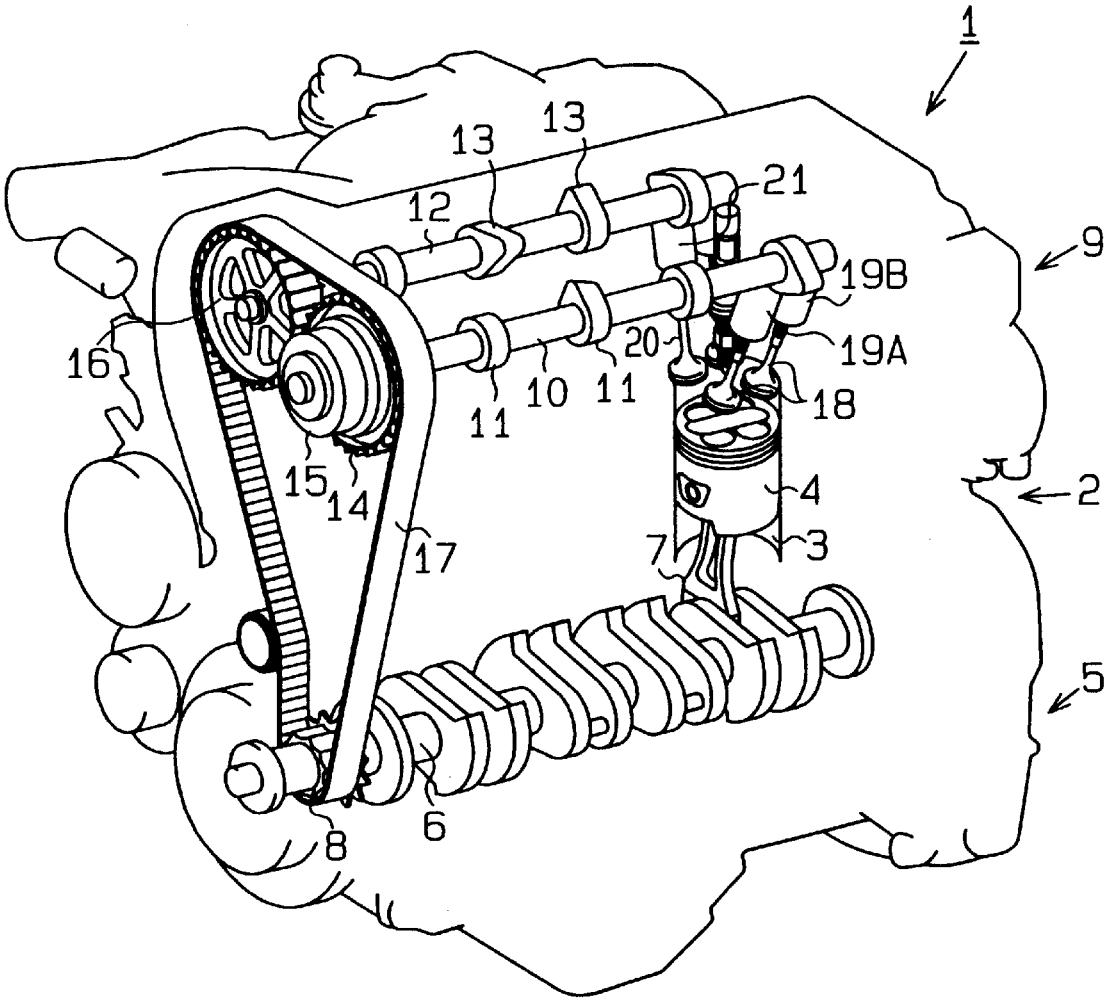
FIG. 2 is a partial perspective view showing an engine provided with the valve driving apparatus of FIG. 1.

FIG. 2 shows an engine 1 provided with a valve driving apparatus according to this embodiment. This engine 1 is a double overhead cam (DOHC) type, in which four valves (two intake valves and two exhaust valves) are associated with one cylinder.

First, the engine 1 will be described with reference to FIG. 2.

The engine 1 includes a cylinder block 2 and a crankcase 5 secured to each other. Cylinders 3 are defined in the cylinder block 2. Each cylinder 3 houses a piston 4. A crankshaft 6 is rotatably supported in the crankcase 5. Each piston 4 is coupled to the crankshaft 6 by a connecting rod 7. One end of the crankshaft 6 is secured to a timing pulley 8.

A cylinder head 9 is secured to the top of the cylinder block 2. An intake camshaft 10 is rotatably supported on the cylinder head 9 by bearings 22 (only one is shown in FIG. 1). The intake camshaft 10 moves axially. Intake cams 11 are located on the camshaft 10. The number of cams 11 is equal to the number of cylinders 3. An exhaust camshaft is also rotatably supported on the cylinder head 9 by bearings (not shown). The exhaust camshaft 12 has exhaust cams 13, the number of which is equal to the number of cylinders 3.

A timing pulley 14 and a shaft moving mechanism 15 are integrally provided on one end of the intake camshaft 10. A timing pulley 16 is fixed to one end of the exhaust camshaft 12. The timing pulleys 14 and 16 are connected to a timing pulley 8 of the crankshaft 6 by a timing belt 17. Rotation of the crankshaft 6 is transmitted to the intake camshaft 10 and the exhaust camshaft 12 by the belt 17. The camshafts 10, 12 are rotated, accordingly.

Figure 4A:
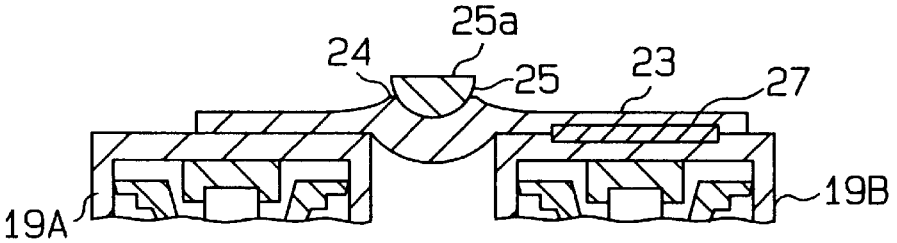
FIG. 4(*a*) is a cross-sectional view illustrating an upper portion of a valve lifter.
Figure 4B:
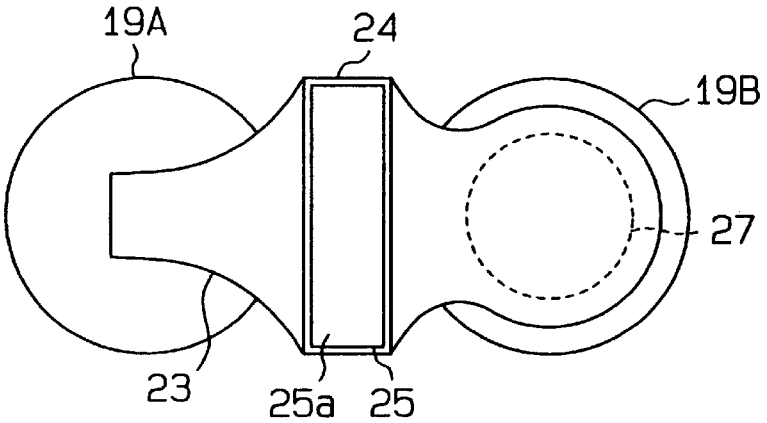
Figure 5:
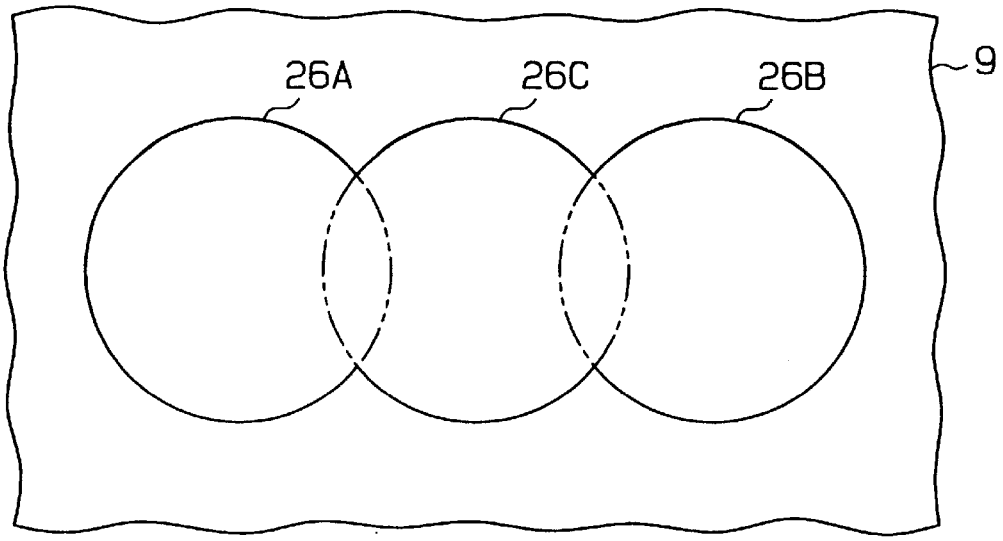
FIG. 5 is a plan view of a lifter bore corresponding to the valve lifter of FIG. 4(*a*)

Each cylinder 3 is provided with a pair of intake valves 18. The intake valves 18 are connected to and driven by the intake cams 11 through valve lifters 19A and 19B. As shown in FIGS. 1, 3 and 4, the valve lifters 19A, 19B have cylindrical shapes and are connected to each other at their tops by a bracket 23. The lifters 19A, 19B and the bracket 23 form an integral lifter structure. The valve lifters 19A, 19B are fitted in lifter opening formed in the cylinder head 9. The lifters 19A, 19B slide with respect to the walls of the opening. FIG. 5 is a plan view of the lifter opening.

As shown in FIG. 5, the lifter bore opening is formed by three overlapping bores 26A, 26B, 26C. Like the prior art lifter bores, the bores 26A and 26B are circular and can thus be formed by drilling or boring. The circular shape facilitates the achievement of the required machining accuracy of the bores 26A, 26B. The bore 26C is formed between the bores 26A and 26B. The center portion of the bracket 23 occupies the bore 26C. In this embodiment the bore 26C has a circular shape like the bores 26A, 26B. However, the bore 26C may have other shapes. Further, the machining accuracy of the bore 26C is not necessarily as high as that of the bores 26A, 26B.

FIGS. 4(*a*) and 4(*b*) are a cross-sectional view and a plan view of the valve lifter structure, respectively. As shown in FIG. 4(*a*), the bracket 23 is directly welded to the top of the valve lifter 19A and is coupled to the second valve lifter 19B with a disk shaped shim 23 in between. The shim 27 is selected from shims having different thicknesses for adjusting the height difference between the first and second valve lifters 19A and 19B.

The bracket 23 also includes a cam follower holder 24 as shown in FIGS. 4(*a*) and 4(*b*). The holder 24 is integrally formed with the bracket 23 and pivotally holds a cam follower 25. The cam follower 25 is urged in a direction to engage the cam 11 by springs 26 located in the valve lifters 19A, 19B. The surface of the cam follower 25, or a sliding surface 25*a*, slides on the cam surface 11*a* of the intake cam 11 (see FIGS. 1 and 3). The cam follower 25 pivots along the cam surface 11*a*.

Further, each cylinder 3 is provided with a pair of exhaust valves 20. Each exhaust valve 20 is driven by the exhaust cam 13 through a valve lifter 21. Each valve lifter 21 is slidably supported in a lifter bore (not shown).

Figure 1:
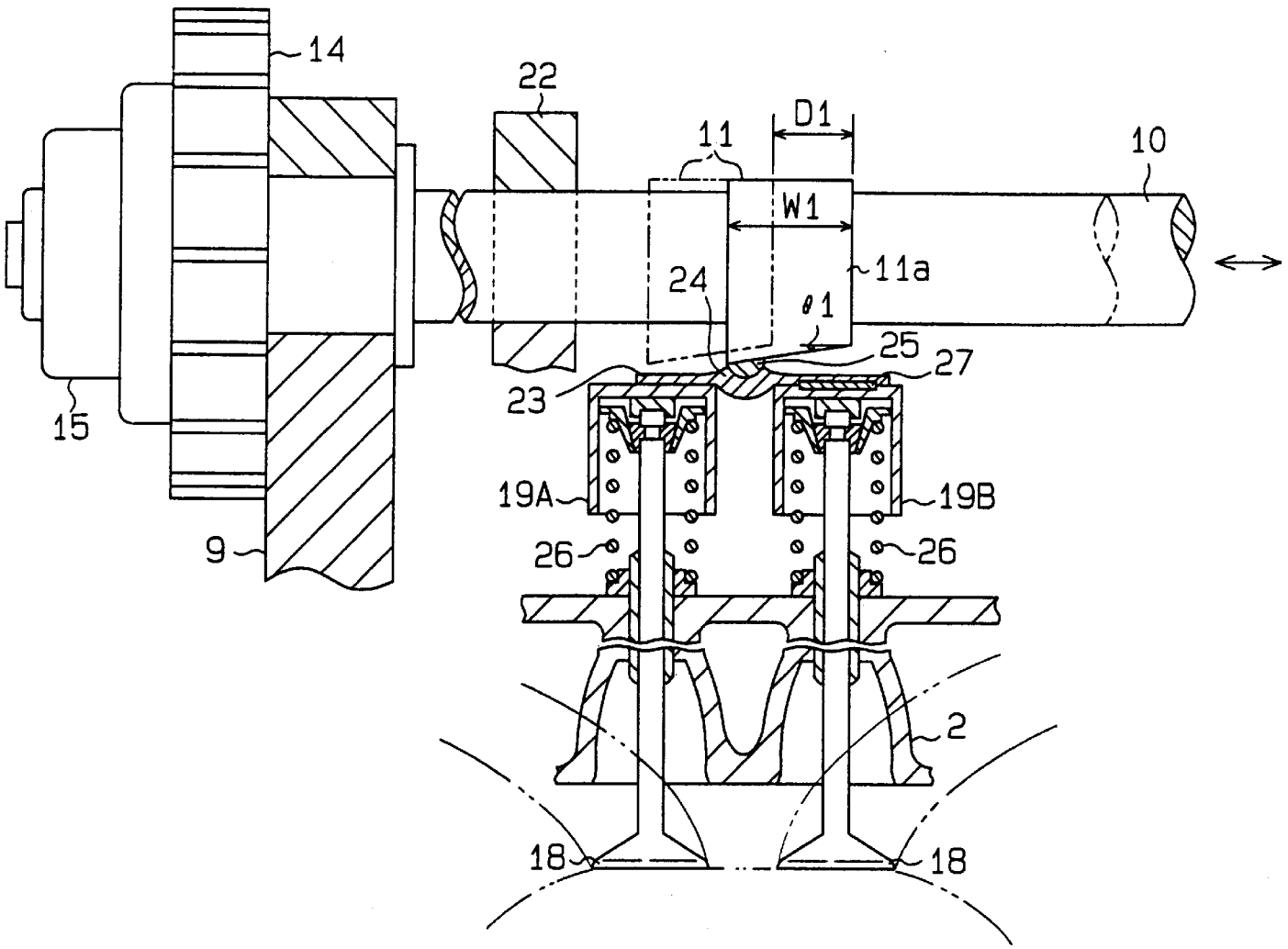
FIG. 1 is a partial cross-sectional view showing a valve driving apparatus according to one embodiment of the present invention.
Figure 3:
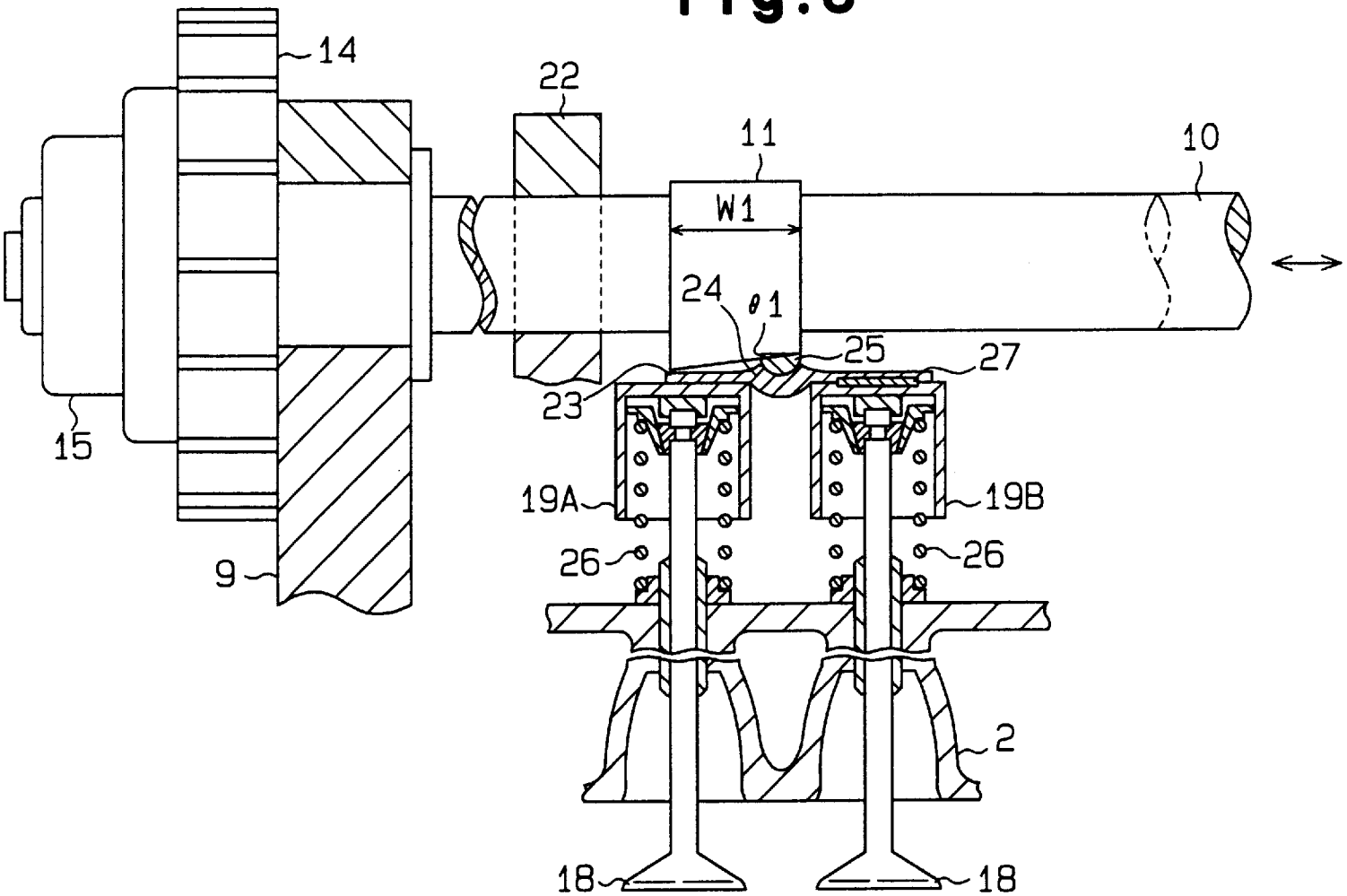
FIG. 3 is a view like FIG. 1 showing the camshaft moved axially from the state shown in FIG. 1.

FIGS. 1 and 3 show the shaft moving mechanism 15, the intake cam 11 and the intake valves 18 that correspond to one cylinder. The intake valves 18 are actuated by the intake cam 11. The bearing 22 is provided in the vicinity of the intake cam 11 for ensuring the rigidity of the camshaft 10. As described above, the intake camshaft 10 is rotatably supported on the cylinder head 9 by the bearing 22 and other bearings and moves in its axial direction.

Figure 12:
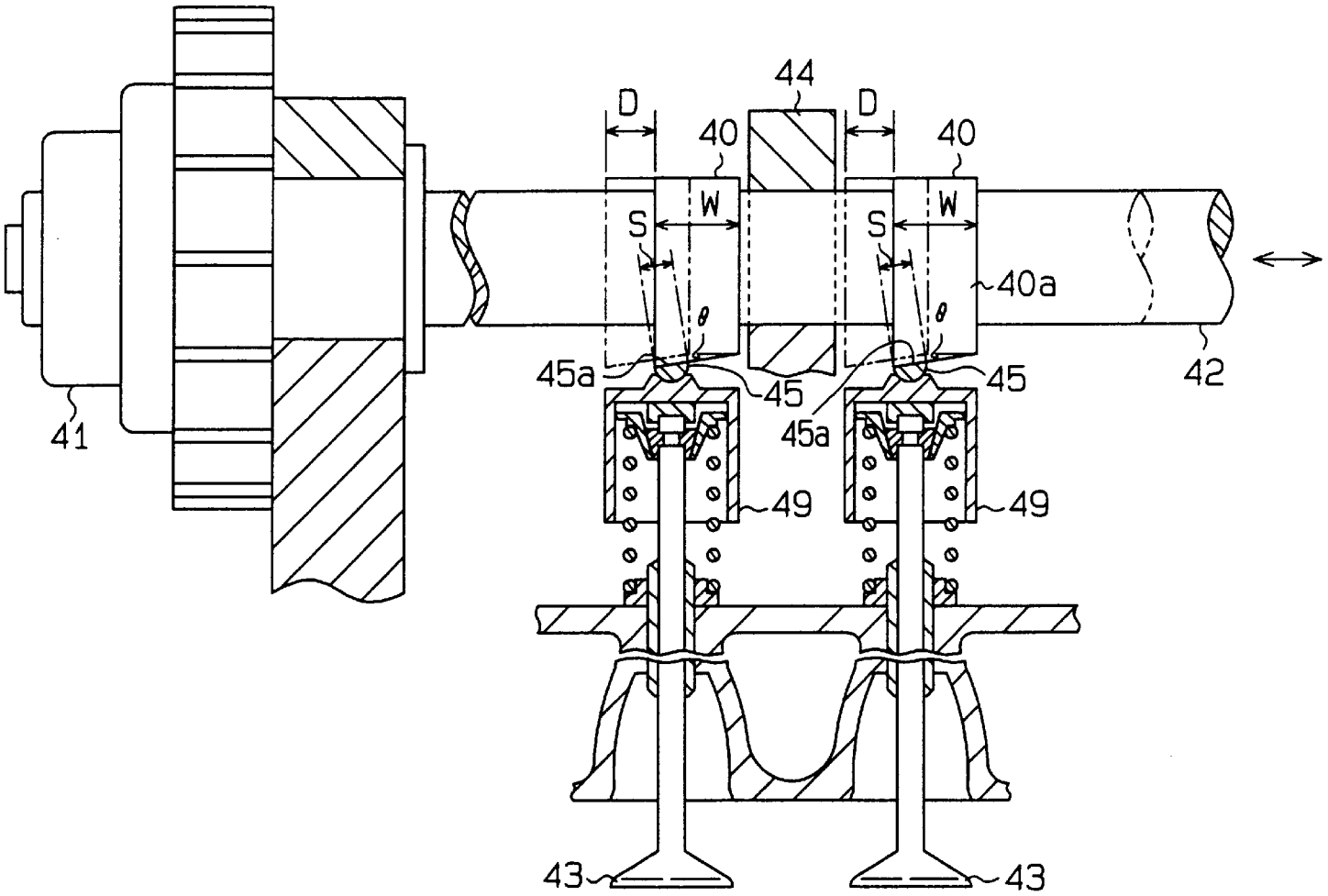
Fig.12 (Prior Art)
FIG. 12 is a cross-sectional view illustrating a prior art valve driving apparatus.
Figure 13:
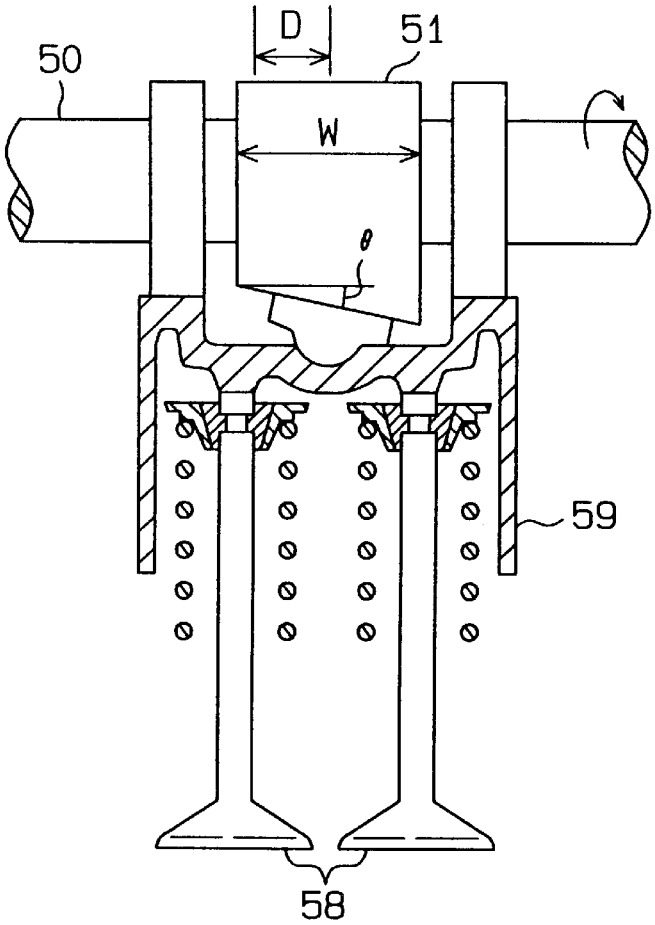
Fig.13 (Prior Art)
FIG. 13 is a partial cross-sectional view illustrating a prior art valve lifter.
Figure 14:
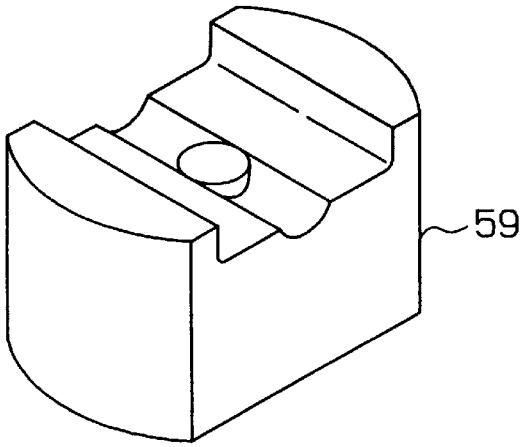
Fig.14 (Prior Art)
FIG. 14 is a perspective view showing the valve lifter of FIG. 13.

The intake cam 11 has substantially the same construction as the prior art solid cam illustrated in FIGS. 12, 13. The radius of the cam surface 11*a* at the cam nose varies continuously in the axial direction. An inclination angle θ1 of the cam surface 11*a* at the cam nose is the same as the inclination angle θ of the cam nose of the cam 40 in the prior art apparatus shown in FIGS. 12, 13. The cam width W1 of the intake cam 11 is however wider than that of the prior art cam 40 shown in FIG. 12. In accordance with the widened width W1, the axial moving amount D1 of the cam 11 is set wider than the moving amount D of the prior art cam 40. That is, although the cam 11 has the same inclination angle θ1 as the inclination angle θ of the cam 40, the difference between the maximum value and the minimum value of the cam nose radius is larger than that of the prior art cam 40.

The shaft moving mechanism 15 is a conventional mechanism driven by a hydraulic circuit (not shown) to move the intake camshaft 10 together with the intake cam 11 in the axial direction. The shaft moving mechanism 15 moves the intake camshaft 10 so that the contact position between the cam surface 11*a* of the intake cam 11 and the surface 25*a* of the cam follower 25 varies between the highest radius position (see FIG. 1) of the cam nose and the lowest radius position (see FIG. 3) of the cam nose.

The operation of the valve driving apparatus of FIGS. 1 to 5 will now be described.

The upper ends of valve lifters 19A, 19B are integrally coupled to the bracket 23. Therefore, unlike the prior art apparatus of FIG. 12 having two cams 40 for actuating two valve lifters, the apparatus of this embodiment needs only one intake cam 11 for actuating the pair of valve lifters 19A, 19B. This construction widens the distance within which the intake cam 11 is movable along the axial direction of the camshaft 10. That is, this construction allows the cam 11 to be wider than the prior art cam 40 while maintaining the inclination angle θ1 of the cam nose of the cam 11 equal to the inclination angle θ of the prior art cam 40.

The increased cam width W1 increases the moving amount D1 of the intake cam 11 compared to the cam moving amount D1 of the prior art apparatus. As a result, the difference between the maximum value and the minimum value of the radius of the cam nose is greater. Therefore, the lift control amount (the range of the valve performance) is increased compared to that of the prior art apparatus. The increased lift control amount enables greater optimization of the amount of intake air. Since the inclination angle θ1 of the cam nose is the same as that of the prior art apparatus, the force for moving the camshaft 10 to the right in FIGS. 1 and 3 is the same as that of the prior art apparatus. Thus, the shaft moving mechanism 15 does not need to be enlarged.

The valve lifters 19A and 19B have a circular cross section. The lifter bores 26A and 26B are also circular like the lifter bores of the prior art apparatus. This construction improves the machining accuracy of the lifter bores 26A, 26B (FIG. 5). The circular shapes of the valve lifters 19A, 19B and the bores 26A, 26B makes it easier to achieve the required assembly accuracy of the valve lifters 19A, 19B and the lifter bores 26A, 26*b*.

The shim 27 located between the bracket 23 and the valve lifter 19B adjusts the height difference between the valve lifters 19A and 19B. Also, the shim 27, together with the bracket 23, prevents the valve lifters 19A, 19B from rotating. Therefore, no other construction is needed for restricting rotation of the valve lifters 19A, 19B.

This embodiment has the following advantages.

The width W1 and the moving amount D1 of the intake cam 11 are increased. As a result, the lift control amount of the intake valves 18 is increased. Therefore, the amount of intake air and the amount of residual gas of the engine 1 are optimally controlled.

The valve lifter 19A, 19B and the lifter bores 26A, 26B have circular shapes and thus are easy to machine. Therefore, it is easy to obtain the required assembly accuracy of the valve lifter 19A, 19B and the bores 26A, 26B.

The shim 27 adjusts the height difference between the valve lifters 19A and 19B, and prevents the valve lifter 19A, 19B from rotating.

The number of the cams is the half of that when each cam corresponds to one valve. This facilitates the manufacture of the camshaft 10.

The embodiment of FIGS. 1 to 5 may be modified as follows:

The camshaft 10 of FIG. 1 moves axially and the intake cams 11, which are secured to the camshaft 10, move integrally with the camshaft 10. However, the camshaft 10 may be axially fixed and the intake cams 11 may axially move with respect to the camshaft 10. This construction has the same advantages as the embodiment of FIGS. 1 to 5.

The valve driving apparatus of FIGS. 1 to 5 may be used for the exhaust valves or for both the intake and exhaust valves. Further, the apparatus may be used in engines other than an engine having four valves per cylinder. For example, the apparatus may be used in engines having six and eight valves per cylinder.

Another embodiment will now be described with reference to FIGS. 6 to 9. The differences from the embodiment of FIGS. 1 to 5 will mainly be discussed below, and like or the same reference numerals are given to those components that are like or the same as the corresponding components of the embodiment of FIGS. 1 to 5.

In this embodiment, the camshaft 10 has two intake cams 11 per cylinder 3. The intake cams 11 are secured to the camshaft 10. Accordingly, each cylinder 3 has a pair of intake valves 18. The valves 18 are inclined along the axis of the camshaft 10 (to the right and left as viewed in FIG. 6) such that the space between the valves 18 is wider toward their upper ends. Specifically, the valves 18 are inclined from the vertical line V of FIG. 6 by an inclination angle $\theta_B$. The valves 18 are operably coupled to the intake cams 11 by the valve lifters 19A, 19B. The valve lifters 19A, 19B are fitted and slide with respect to lift bores (not shown).

The exhaust camshaft 12 also has two exhaust cams 13 per cylinder 3. Each cylinder 3 has a pair of exhaust valves 20. The exhaust valves 20 are operably coupled to the exhaust cams 13 through valve lifters 21. Each valve lifter 21 is slidably fitted in a lifter bore (not shown). The shaft moving mechanism 15 of this embodiment has substantially the same construction as that of the embodiment of FIGS. 1 to 5 except that the bearing 22 is located between the adjacent intake cams 11 forming the pair.

The intake cams 11 are conventional solid cams. The radius of the cam surface 11*a* at the cam nose varies continuously in the axial direction. An inclination angle θ1 of the cam surface 11*a* at the cam nose is the same as the inclination angle θ of the cam nose of the cam 40 in the prior art shown in FIG. 12.

Figure 9:
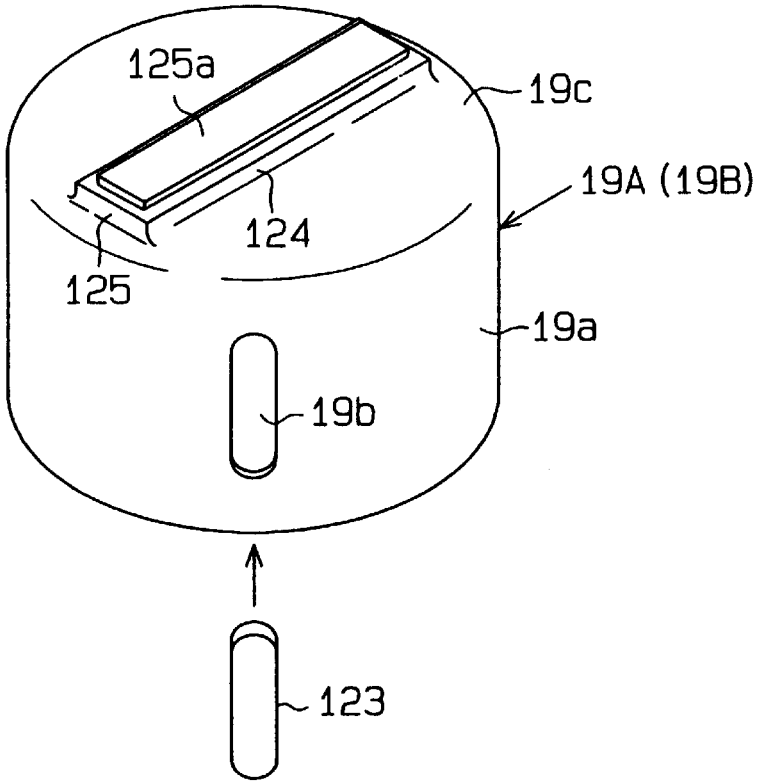
FIG. 9 is an enlarged perspective view showing a valve lifter in the apparatus of FIG. 6.

The valve lifters 19A, 19B have the same shape. As shown in FIG. 9, the valve lifters 19A, 19B have a cylindrical shape. A guide member 123 is provided on the outer peripheral surface 19*a* thereof. The guide member 123 is secured to a recess 19*b* formed in the outer peripheral surface 19*a* by press fitting or welding. The guide member 123 is engaged with a structure (not shown) such as a groove formed in the inner peripheral surface of the lifter bore. This prevents the valve lifters 19A and 19B from rotating, but allows them to slide in the axial direction of the lifter bores.

The valve lifters 19A and 19B each have cam follower holders 124 integrally formed in their upper surfaces 19*c*. A cam follower 125 is pivotally supported in the holder 124. As shown in FIG. 9, the holder 124 is located in the center of the upper surface 19*c* of the valve lifters 19A, 19B. Each cam follower 125 is urged in a direction to engage the cam 11 by springs 126 located in the valve lifters 19A, 19B. The surface of the cam follower 125, or a sliding surface 125*a*, slides on the surface 11*a* of the intake cam 11 (see FIGS. 6 and 8). The cam follower 125 pivots along the cam surface 11*a*. In this embodiment, the width S1 of the cam followers 125 is equal to the width S of the prior art cam followers 45 illustrated in FIG. 12.

Figure 6:
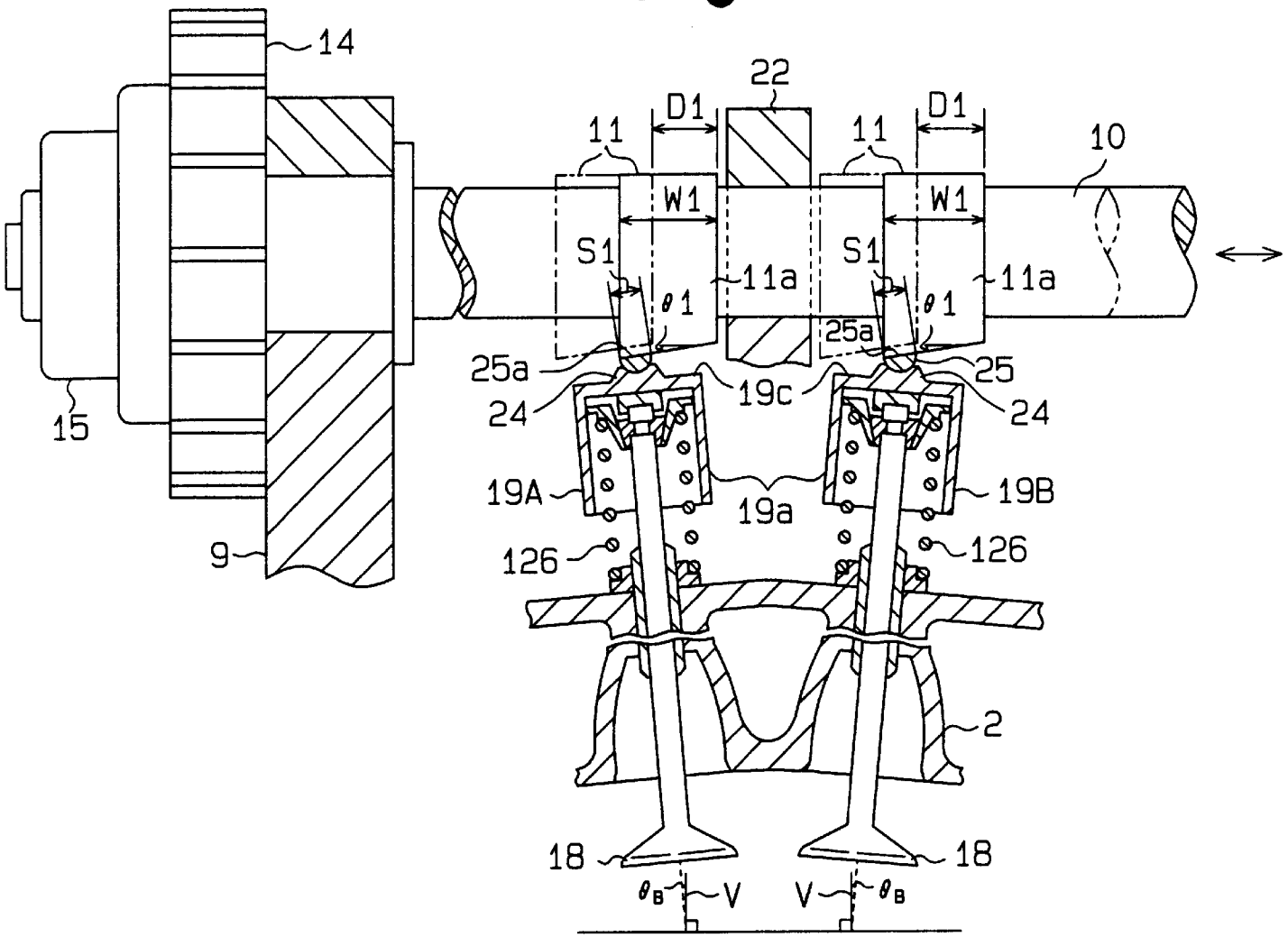
FIG. 6 is a partial cross-sectional view showing a valve driving apparatus according to yet another embodiment of the present invention.
Figure 7:
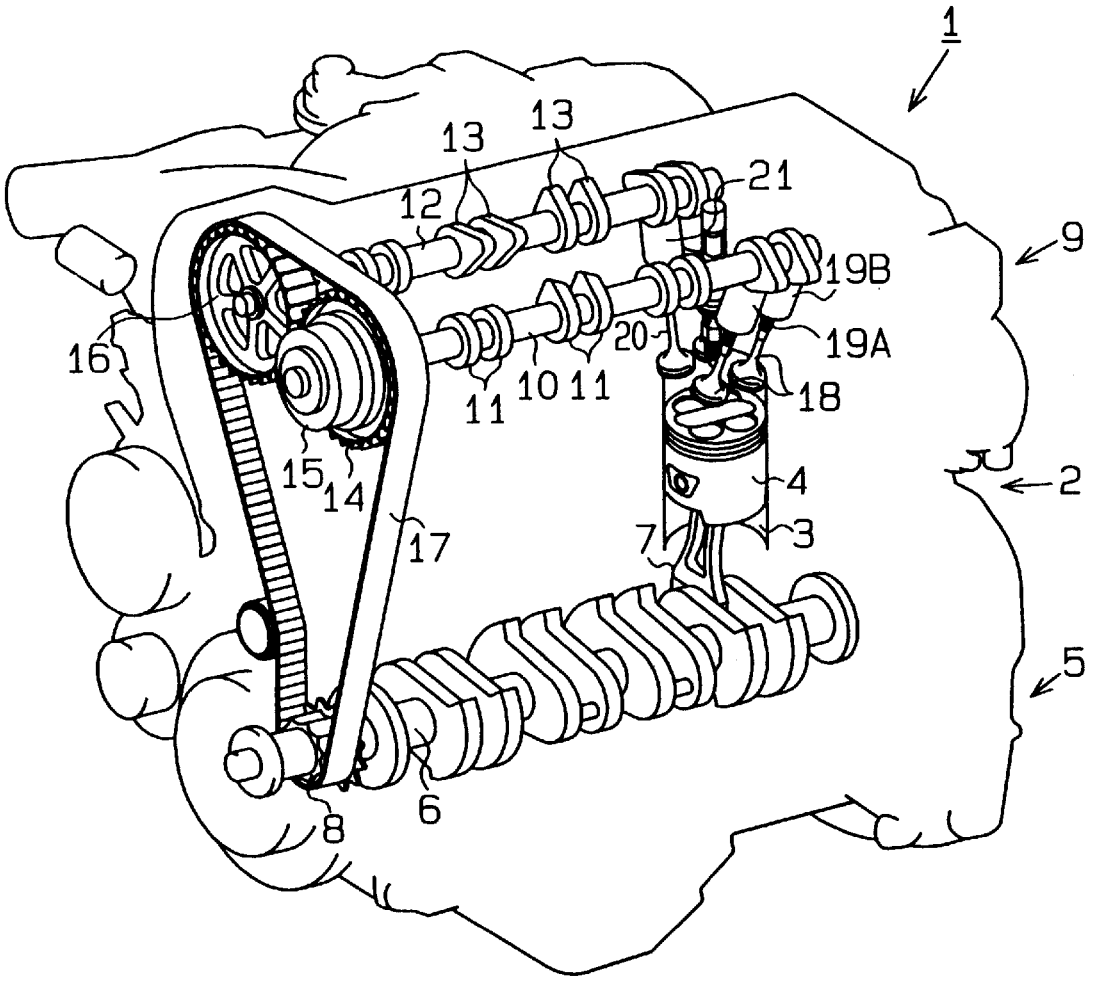
FIG. 7 is a partial perspective view showing an engine provided with the valve drive device of FIG. 6.
Figure 8:
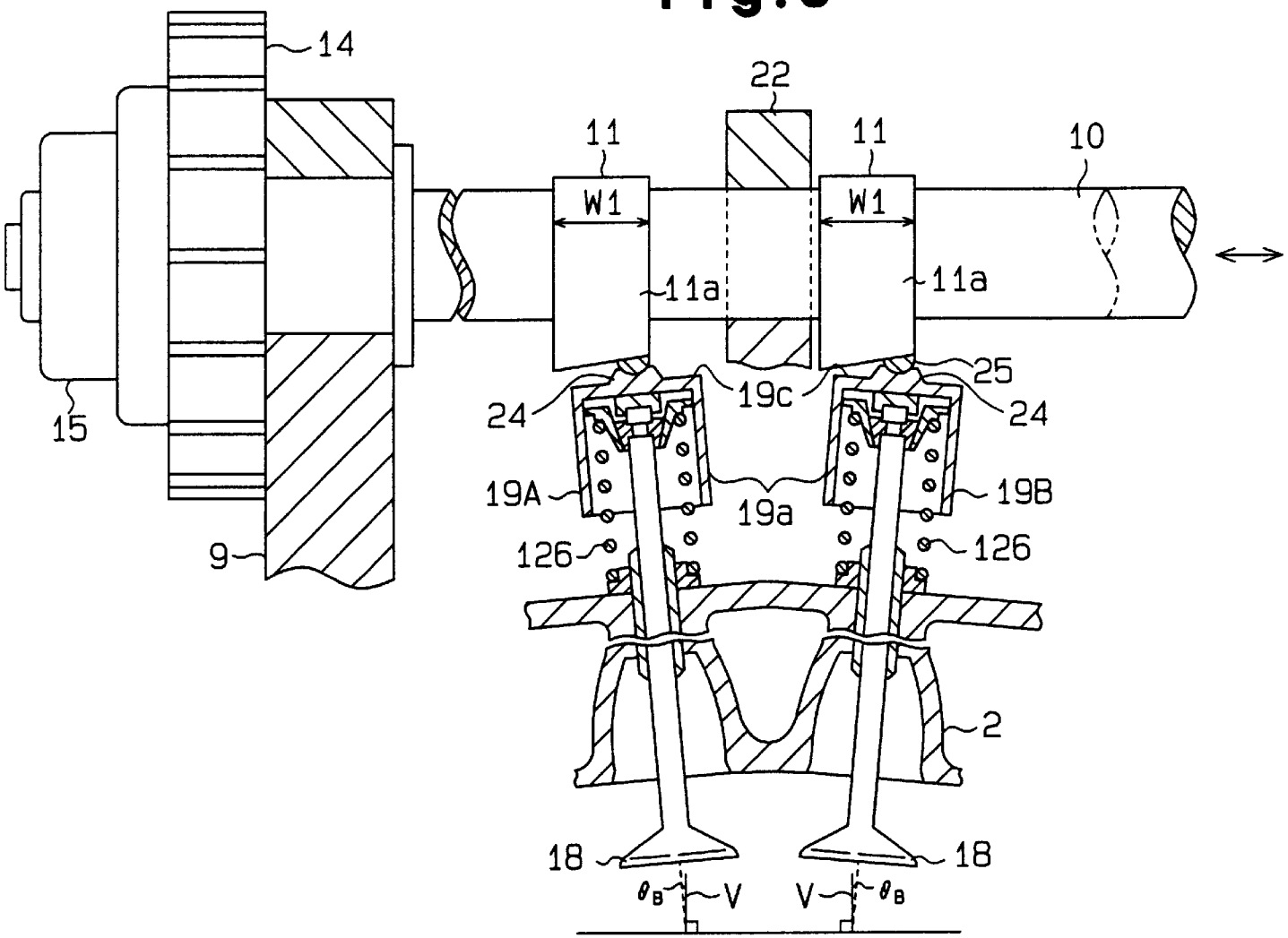
FIG. 8 is a view like FIG. 6 showing the camshaft moved axially from the state shown in FIG. 6.

As shown in FIGS. 6 and 8, a pair of intake valves 18, which are located on both sides of a bearing 22, are inclined with respect to a radius of the camshaft 10 such that the upper ends are set apart by a greater amount than their lower ends. This construction allows the width W1 of each intake cam 11 to be greater than the width W of the prior art cam 40 The increased cam width W1 allows the moving amount D1 of the cams 11 to be greater than the moving amount D of the prior art cam 40. That is, although the cam 11 has the same inclination angle θ1 of the cam surface 11*a* at the cam nose as the inclination angle θ of the cam nose of the cam 40, the difference between the maximum value and the minimum value of the radius of the cam nose is larger than that of the prior art cam 40.

The shaft moving mechanism 15 is a conventional mechanism driven by a hydraulic circuit (not shown) to move the intake camshaft 10. The shaft moving mechanism 15 moves the intake camshaft 10 so that the contact position between the cam surface 11*a* of the intake cam 11 and the surface 125*a* of the cam follower 125 varies between the lowest radius position (see FIG. 8) of the cam nose and the highest radius position (see FIG. 6) of the cam nose.

The intake valves 18 are inclined such that the distance between their upper ends along the camshaft 10 is greater. This expands the space between the intake cams 11 without increasing the space between the lower ends of the valves 18, which are located in the combustion chamber of a single cylinder 3. That is, this construction increases the width W1 of the cam 11 as compared to the width W of the prior art cam 40 without changing the inclination angle θ1 of the cam nose of the cam 11. In accordance with the increased width W1, the moving amount D1 of the cam 11 is greater than the moving amount D of the prior art cam 40. Therefore, the difference between the maximum value and the minimum value of the radius of the cam nose is larger than that of the prior art cam 40. Thus, the lift control amount (range of valve performance) is increased compared to that of the prior art apparatus. The increased lift control amount enables greater optimization of the amount of intake air for the various driving conditions of the engine 1.

The roof of an engine cylinder having four valves typically is defined by two intersecting planes (like the roof of a house). However, the inclined intake valves 18 makes the shape of the roof of the combustion chambers closer to a hemispheric shape, which is ideal. This improves the combustion efficiency of fuel thereby preventing knocking of the engine. Thus, the performance of the engine is improved.

Since the inclination angle θ1 of the cam nose is the same as that of the prior art apparatus, the load for moving the camshaft 10 to the right in the drawings is the same as that of the prior art apparatus. Thus, the shaft moving mechanism 15 does not need to be enlarged.

The width S1 of the sliding surface 125*a* is equal to the width S of the sliding surface 45*a* of the prior art. Therefore, the pressure acting on the surface 125*a* is not greater than the pressure acting on the surface 45*a*. The cam follower 125 thus does not wear out faster than the prior art cam follower.

The apparatus of FIGS. 6–9 has the following advantages.

Inclination of the intake valves 18 allows the width W1 and the moving amount D1 of the intake cam 11 to be increased. As a result, the lift control amount of the intake valves 18 is increased. Therefore, the amount of intake air and the amount of residual gas of the engine 1 are controlled with greater optimization.

The prior art cams and valve lifters may be used in the apparatus of FIGS. 6–9. This facilitates the design of the apparatus and lowers the manufacturing cost.

The embodiment of FIGS. 6–9 may be modified as the follows.

Figure 10:
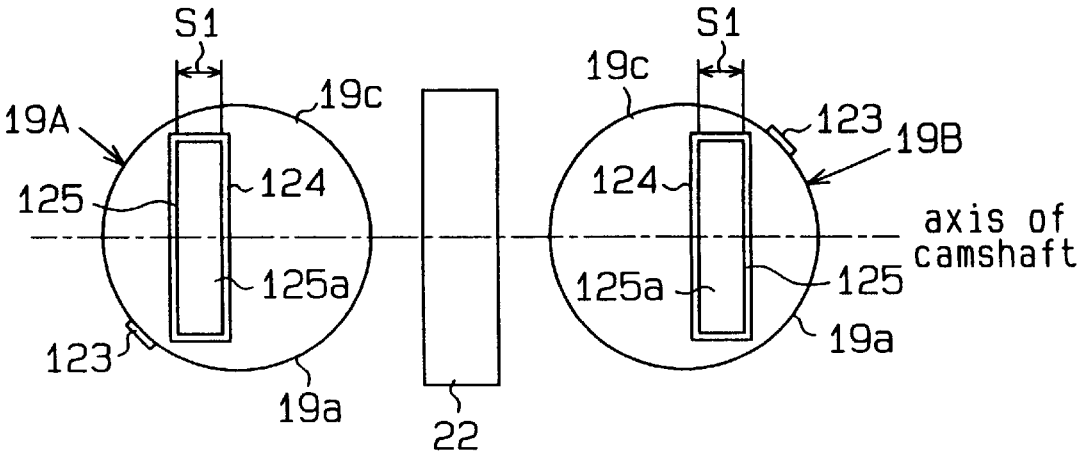
FIG. 10 is a plan view of a pair of valve lifters according to another embodiment.

In the embodiment of FIGS. 6–9, the cam follower holder 124 and the cam follower 125 are located in the center of the upper surface 19*c* of the valve lifter. However, the cam follower holder 124 and the cam follower 125 may be located other positions. For example, each holder 124 may be laterally offset from the center of the upper surface 19*c* in a direction away from the bearing 22 as illustrated in FIG. 10. This construction further increases the cam width W and the cam moving amount D.

Figure 11:
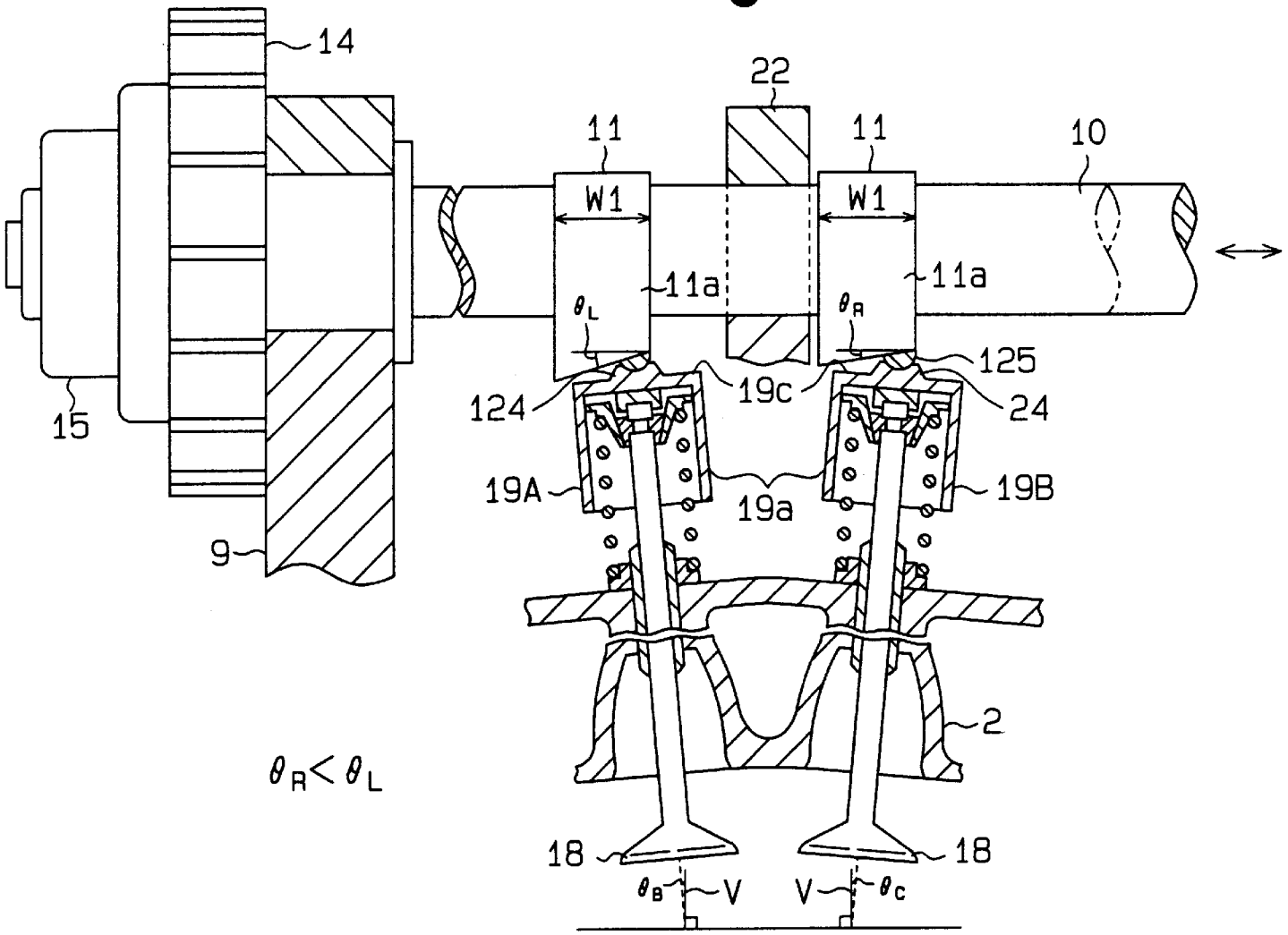
FIG. 11 is a cross-sectional view showing a valve driving apparatus according to another embodiment of the present invention.

In the embodiment of FIGS. 6–9, the angles of the cam nose inclination angle θ1 of the cams 11, which have the bearing 22 in between, are the same. However, the inclination angles θ1 of the cams 11 may be different. For example, as shown in FIG. 11, the cam nose inclination angle $\theta_L$ of the left cam 11 may be greater than the cam nose inclination angle $\theta_R$ of the right cam 11. Accordingly, the inclination angles $\theta_B$ and $\theta_C$ of the associated intake valves 18 are changed. Changing the cam nose inclination angles of adjacent intake cams 11 changes the valve lift of the intake valves 18 when the valve lift is small. This causes air drawn through the intake valves 18 to be agitated thereby producing turbulence in the combustion chamber. The turbulence improves the combustion efficiency.

Unlike the embodiment of FIG. 11, the cam nose inclination angle $\theta_R$ of the right cam 11 may be greater than the cam nose inclination angle $\theta_L$ of the left cam 11.

In the embodiments of FIGS. 6–11, the camshaft 10 moves axially and the intake cams 11, which are secured to the camshaft 10, move integrally with the camshaft 10. However, the camshaft 10 may be axially fixed and the intake cams 11 may axially move with respect to the camshaft 10. This construction has the same advantages as the embodiment of FIGS. 1 to 5.

The valve driving apparatuses of FIGS. 6 to 11 may be used for the exhaust valves or for both the intake and exhaust valves. Further, the apparatus may be used in engines other than the engine having four valves per cylinder. For example, the apparatus may be used in engines having six and eight valves per cylinder.

Therefore, the present examples and embodiments are to be considered as illustrative and not restrictive and the invention is not to be limited to the details given herein, but may be modified within the scope and equivalence of the appended claims.

What is claimed is:

1. A valve driving apparatus for an engine comprising:

a camshaft rotatably supported by the engine;

a combustion chamber having a pair of ports;

a pair of valves associated with the ports, respectively, for selectively opening and closing the respective ports, wherein the valves each have a longitudinal axis, a head end, and an outer end, which is opposite to the head end, the valves being oriented with their longitudinal axes inclined with respect to a radius of the camshaft such that the distance between the head ends of the valves is less than the distance between the outer ends;

a pair of cams provided on the camshaft, the axial distance between the cams being fixed, each cam being associated with one of the valves, wherein each cam lifts the associated valve along its axis in response to rotation of the camshaft, each cam having a cam nose for lifting the associated valve, wherein the radius of each cam nose varies in the axial direction so that each valve is driven with a variable amount of valve lift;

a pair of cam followers for transmitting movement of the cams to the valves, respectively, wherein each cam follower contacts the associated cam at a contact position; and an actuator for integrally moving the cams relative to the associated valves in an axial direction of the camshaft to vary the amount of valve lift of each valve, wherein the actuator selectively moves the camshaft in either of two opposite axial directions, and wherein the movement of each cam varies the contact position of each cam follower on the associated cam.

2. The valve driving apparatus according to claim 1 further comprising a valve lifter located between each cam follower and the associated valve, wherein the valve follows the motion of the associated valve lifter.

3. The valve driving apparatus according to claim 2 further comprising a spring for urging each valve, each valve lifter and each cam follower toward the associated cam.

4. The valve driving apparatus according to claim 2, wherein each cam follower is pivotally supported by an associated one of the valve lifters.

5. The valve driving apparatus according to claim 1 further comprising a plurality of bearings for supporting the camshaft, at least one bearing being located between the valves.

6. The valve driving apparatus according to claim 4, wherein each valve lifter is cylindrical and has a top surface.

7. The valve driving apparatus according to claim 6, wherein each cam follower is located substantially at the center of the top surface of the associated valve lifter.

8. The valve driving apparatus according to claim 6, wherein each cam follower is offset from the center of the top surface of the associated valve lifter.

9. The valve driving apparatus according to claim 1, wherein the valves are inclined symmetrically with respect to a plane that is perpendicular to the camshaft.

10. A valve driving apparatus for an engine comprising:

a camshaft rotatably supported by the engine;

a combustion chamber having a pair of ports;

a pair of valves, each valve having a valve face and a valve stem, wherein each valve face selectively opens and closes an associated one of the ports, wherein each valve stem has a distal end and a proximal end, the proximal end being connected to the valve face, and wherein the valves are inclined such that the distal ends of the valve stems are further from each other than their proximal ends;

a pair of cams provided on the camshaft, each cam being associated with one of the valves, wherein each cam lifts the associated valve along its axis in response to rotation of the camshaft, each cam having a cam nose for lifting the associated valve, wherein the radius of each cam nose varies in the axial direction so that each valve is driven with a variable amount of valve lift;

a pair of cam followers for transmitting movement of the cams to the valves, respectively, wherein each cam follower contacts the associated cam at a contact position; and an actuator for moving the cams relative to the associated valves in either of two opposite axial directions of the camshaft to vary the amount of valve lift of each valve, wherein the movement of each cam varies the contact position of each cam follower on the associated cam, and wherein the axial position of the cams is determined by an operating condition of the engine.

* * * * *

UNITED STATES PATENT AND TRADEMARK OFFICE

CERTIFICATE OF CORRECTION

PATENT NO. : 5,988,128
DATED : November 23, 1999
INVENTOR(S) : Yoshihito Moriya et al.

It is certified that error appears in the above-identified patent and that said Letters Patent is hereby corrected as shown below:

Column 2,
Line 12, after "width W" insert --of--.
Line 19, after "shape" insert --.--.
Line 59, after "easy" insert --to--.
Line 63, after "apparatus" insert --comprises--.

Column 4,
Line 53, change "is not necessarily" to --does not have to be--.

Column 8,
Line 11, change "makes" to --make--.
Line 43, after "located" insert --at--.

Signed and Sealed this

Third Day of July, 2001

*Attest:*

Nicholas P. Godici

*Attesting Officer*

NICHOLAS P. GODICI
*Acting Director of the United States Patent and Trademark Office*